US006408895B1

(12) United States Patent
Beam

(10) Patent No.: US 6,408,895 B1
(45) Date of Patent: Jun. 25, 2002

(54) VAPOR CONTROL SYSTEM FOR LOADING AND UNLOADING OF VOLATILE LIQUIDS

(76) Inventor: Craig A. Beam, c/o Propax Corporation 7723 Wycomb La., Houston, TX (US) 77070-3730

( * ) Notice: Subject to any disclaimer, the term of this patent is extended or adjusted under 35 U.S.C. 154(b) by 0 days.

(21) Appl. No.: 09/660,272

(22) Filed: Sep. 12, 2000

Related U.S. Application Data

(60) Provisional application No. 60/153,751, filed on Sep. 13, 1999.

(51) Int. Cl.[7] ..... B65B 1/04
(52) U.S. Cl. ..... 141/59; 141/82; 141/302
(58) Field of Search ..... 141/59, 82, 284, 141/285, 286, 2, 18, 11, 44, 45, 301, 302

(56) References Cited

U.S. PATENT DOCUMENTS 5,409,046 A * 4/1995 Swenson et al. ..... 141/11
5,505,232 A * 4/1996 Barclay ..... 141/11
5,771,946 A * 6/1998 Kooy et al. ..... 141/82
5,878,792 A * 3/1999 Pettazzoni et al. ..... 141/59

* cited by examiner

*Primary Examiner*—Steven O. Douglas
(74) *Attorney, Agent, or Firm*—Mark R. Wisner

(57) ABSTRACT

Apparatus for controlling vapor so as to increase the rate of flow of liquid while moving from one vessel to a second vessel by replacing pumped off liquid with vapor from the liquid and then depressurize the first vessel. After the first vessel is emptied of liquid, the first vessel is depressurized by pulling the vapor out of the first vessel, condensing the vapor, and routing the condensed vapor to the second vessel. The vapor utilized for balancing the first and second vessels during movement of liquid is vapor from the head space of the second vessel or vapor obtained by vaporizing a side stream of the liquid being pumped from the first vessel to the second. The system is also adapted for assisting with the recovery of vent gas from the vent gas recovery system of the facility.

13 Claims, 1 Drawing Sheet

VAPOR CONTROL SYSTEM FOR LOADING AND UNLOADING OF VOLATILE LIQUIDS

This applications benefits 60/153,751 filed Sep. 13, 1999.

BACKGROUND OF THE INVENTION

The present invention relates methods and apparatus for moving liquids, particularly volatile liquids, from one, vessel to another. In more detail, the present invention relates to methods and apparatus for balancing the vapor pressure of two liquid vessels, such as a storage tank and a railroad car, during the movement of the liquid from one vessel to the other so as to increase the rate of fluid movement and decrease vapor loss, for depressurizing the vessel from which the liquid is pumped, and for assisting with the recovery of vent gas from the vent gas recovery system of the facility.

Equipment is disclosed in the patent literature, and a number of systems are currently in use, for loading and unloading liquids from, for instance, a barge to a storage tank or a storage tank to a tank truck. U.S. Pat. Nos. 3,527,384 and 4,014,358 describe equipment and methods for moving liquids from one container to another. Of particular concern in the movement of such liquids are combustible and/or volatile liquids, and the patent literature includes, for instance, U.S. Pat. Nos. 3,783,911 and 5,125,439, directed to methods for collecting and/or controlling vapor emissions during loading and unloading of such liquids. It is also known in the art to inject natural gas or propane into the ullage of the tank from which the liquid is pumped to balance the tanks and then to flare off that gas to depressurize the tank.

In addition to the flammability of the vapors and/or the gas used to balance the tanks during loading and unloading, such systems are complicated by the distance the liquid must be moved and/or the physical requirements of the facility at which they are being moved. For instance, it is not uncommon to have a loading/unloading facility at which the liquid must be moved from a barge to a storage tank that may be several hundred, or even several thousand, feet away from the barge. Further, for safety and other reasons, the pumps and electrical equipment for moving the liquid may be located remotely from the barge. In short, the design of such systems is almost always constrained by the specifics of each installation.

There is, therefore, a need for methods and apparatus which are adaptable for moving liquids from one container to another for use in many locations, regardless of the distance the liquid must be transported and the available electrical capacity and proximity. There is also a need for methods and apparatus which are safely used for moving combustible and highly volatile liquids from container to container. There is also a need for methods and apparatus which increase the speed with which liquids are moved from one container to another. There is also a need to reduce facility-wide vented vapors which must be separately compressed, condensed and piped to storage tanks.

SUMMARY OF THE INVENTION

These needs, and others known to those skilled in the art, are met by providing an apparatus for balancing vapor while moving liquid from a first vessel to a second liquid storage vessel comprising a pump for unloading or loading liquid from a first vessel to a second vessel, a vapor source, and a vapor line in fluid communication with the vapor source and the first vessel for returning vapor to the first vessel to replace the liquid pumped from the first vessel to maintain pump suction pressure. A separator with a heating coil and a compressor is provided for pulling vapor off the then-unloaded second vessel as is a condenser (which is in fluid communication with the compressor and the second vessel) for changing vapor from the compressor to liquid and then routing the liquid to the second vessel.

DETAILED DESCRIPTION OF THE PREFERRED EMBODIMENT

Figure 1:
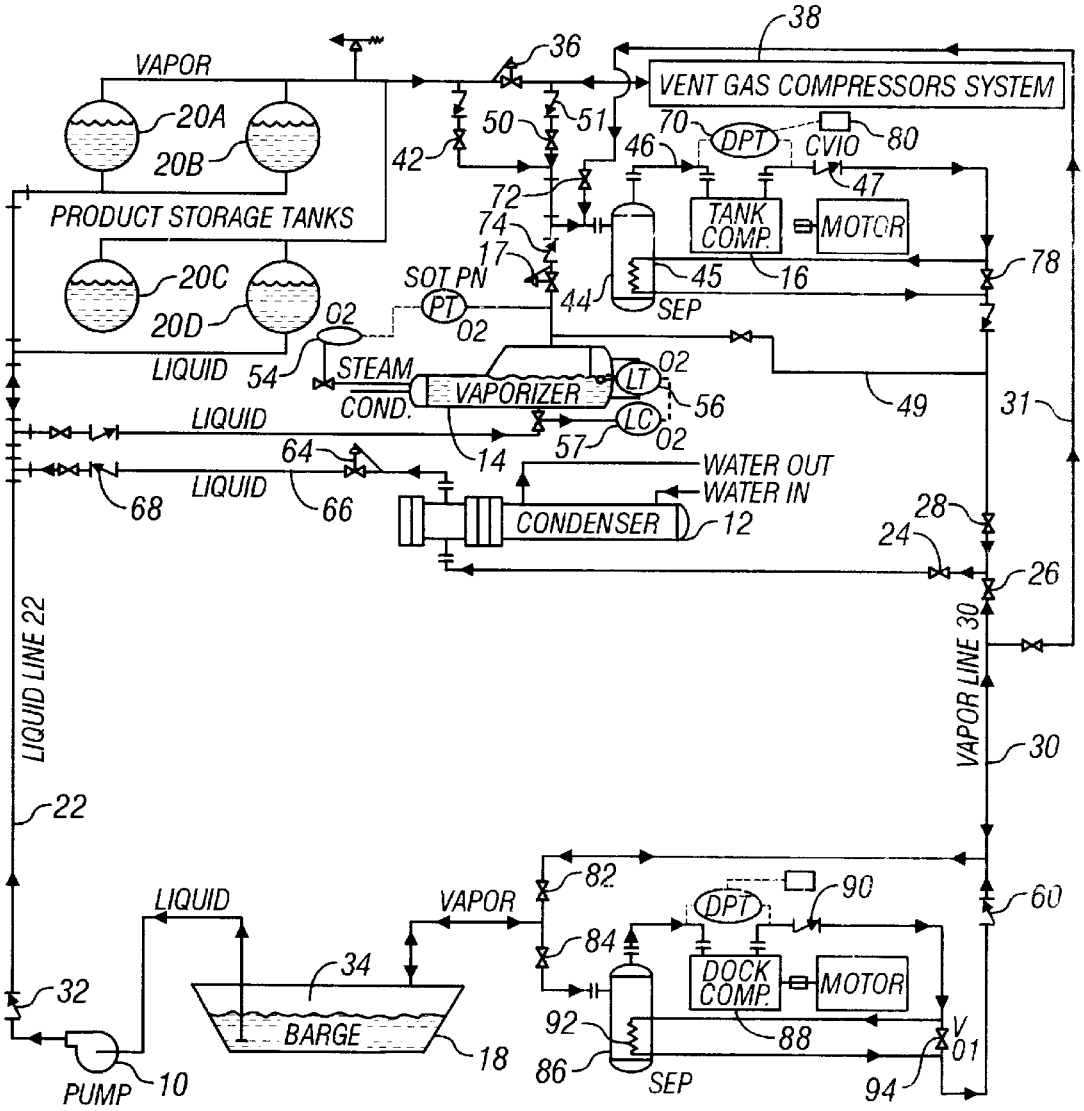
FIG. 1 is a schematic diagram of a preferred embodiment of a barge liquid unloading and barge vapor depressurizing system constructed in accordance with the teachings of the present invention.

Chemical plants and/or refineries typically include certain equipment for loading and unloading of vessels such as rail tank cars, tank trucks, and barges. This equipment usually includes storage tanks, pump(s), pipes, valves, and fittings and, in some installations, a vaporizer or equipment for injecting natural gas into the vessel from which the liquid is being unloaded. Regardless of whether the vaporized liquid or natural gas is used to pressurize the vessel from which the liquid is unloaded, the vaporized liquid or natural gas is typically either left in the vessel or flared off. The present invention is designed to interconnect with this on-site equipment to facilitate liquid loading and unloading and subsequent depressurization of the vessel from which the liquid is unloaded.

Referring to FIG. 1, a preferred embodiment of a system constructed in accordance with the teachings of the present invention is shown schematically. The system is comprised of five main components, a pump 10 (which is the pump which is typically found at the installation), compressor 16 (which may be a compressor already in use at the installation), condenser 12, vaporizer 14 (which may also be the vaporizer which is in use at the installation), and the piping, valves, and controls for operating these components while moving the liquid from one vessel to another. These components are combined in a system such as the system shown in FIG. 1 for loading and unloading liquid product from/to a barge to a product storage tank(s) and subsequently depressurizing the vessel from which the liquid is unloaded.

In more detail, the system shown in FIG. 1 is adapted for moving liquid to or from a barge 18 to or from one or more product storage tanks 20A–20D through liquid line 22. To unload liquid from barge 18, pump 10 is switched on, valve 24 is closed, and valves 26 and 28 in vapor line 30 are opened. Liquid flows from barge 18 through check valve 32 to storage tanks 20A–20D. As the volume of liquid in the barge 18 is depleted, the rate of fluid flow through liquid line 22 decreases unless barge 18 is vapor pressure balanced by delivering vapor to the ullage 34 of the barge to make up for the displacement loss from the liquid pump off rate. The vapor delivered to the ullage 34 of barge 18 comes from one or both of two sources depending upon the particular installation. The primary vapor source is the tank vapor head space, or ullage, of the product storage tanks 20A–20D. This vapor is returned to the barge 18 by opening valve 42 and insuring that valve 50 is closed. When not being returned to the barge 18, this vapor is constantly being lost due to tank filling and normal tank liquid vaporization through the pressure regulator 36 to the vent gas compressor system 38 of the facility which, on information and belief, is utilized for the purpose of preventing the loss of vapor to the atmosphere at every such facility. In the particular installation shown in the figure, and in other similar installations, the facility at which the vapor balancing system of the present invention is installed includes a compressor 16 which is used for compressing and returning the vapor from the storage tanks 20A–20D by opening valve 42 to allow tank vapor to enter the separator 44 and on to the compressor 16 through line 46. A discharge check valve 47 prevents back flow of compressed gas into the compressor 16 when the compressor is stopped.

However, vapor from the tank vapor space is normally insufficient to provide adequate vapor pressure to balance the displacement rate from the barge 18. The present invention therefore contemplates the use of vaporizer 14 for providing vapor flow sufficient to make up the difference to balance the pump displacement rate. Vaporizer 14 receives liquid from the pump discharge/liquid line 22 by opening control valve 15, which is controlled by the level transmitter 56 to maintain constant liquid level in vaporizer 14. The vapor pressure of vaporizer 14 is controlled by pressure transmitter 57 which controls the inlet steam valve 54. It is generally desirable to reduce vapor losses to the vent gas compressor system 38, so in the preferred embodiment of the present invention a pressure regulator 17 is provided that is set to make up vapor pressure from the vaporizer as required by the system to control the vapor flow as required by the barge pump displacement rate.

Compressor 16 has an additional function that confers a significant advantage upon the particular embodiment shown in FIG. 1. Specifically, compressor 16 is also sized to pull down and compress vent gas from downstream of the pressure regulator 36 through valve 50 and check valve 51. The pressure regulator 36 is set at a selected set value which, when exceeded, routes vapor to the facility vent gas compressor system 38 at a much lower, but still positive, pressure. By opening valve 50 and closing valve 42, that same positive pressure vent gas is then re-routed to separator 44 and compressor 16. The load on the existing facility vent gas compressor system 38 is significantly reduced at no additional cost over the cost of providing the equipment necessary to pressurize the vapor as needed to balance the barge 18 during unloading operations and depressurizing the barge 18 as described below. This operating characteristic and cost savings of the pressure balancing system of the present invention makes the present invention particularly advantageous in the many installations in which, for instance, the facilities production capacity has been repeatedly expanded, thereby increasing the load on the facility vent gas compressor system to a level out or beyond capacity. The addition of the pressure control system of the present invention, when installed in this manner, may prevent the need for additional vent gas compression.

To depressurize the vapors from barge 18, the pump 10 is turned off and compressor 16 pulls vapor from the barge through valve 82 back through vapor line 30 to vapor line 31 by closing valve 26. Opening valve 72 and closing valves 50 and 42 routes the barge vapor only into separator 44. Separator 44 is provided with an internal heating coil 45 that vaporizes liquid entering separator 44. The temperature of coil 45 is adjusted by the operator by modulating valve 78 to divert hot compressed gas through the coil as needed. The gas is then compressed and routed to condenser 12 by opening valves 24 and 28. Condenser 12, of course, changes the vapor back to a liquid and the piping 66 routes the liquid on through pressure regulator 64, which holds the condensing temperature at the optimum point. Depending on whether the cooling media of the condenser 12 is water or air, the regulator 64 is adjusted, if necessary, to raise the condensing temperature. Those skilled in the art will recognize that this adjustment allows an increase in condensing temperature substantially above ambient air or available cooling water temperature which can substantially reduce required surface area, thereby decreasing the cost of condenser 12.

From pressure regulator 64, the liquid goes through check valve 68 and back to the product storage tanks 20A–20D. Compressor 16 is provided with a differential pressure transmitter 70 for automatically controlling the compressor loading and unloading to match the rate of liquid pump off. To allow this single compressor to handle these multiple flow rates and multiple pressures, the differential pressure transmitter 70 is provided with a site programmable alarm 80 which is programmed to automatically load and unload compressor 16 depending upon the recorded differential pressure as sent to the pre-programmed alarm switch 80. The programmable pressure alarm can be any commercially available alarm supplied by, for instance, Moore Industries-International, Inc. (California) with a current input and multiple programmable alarm outputs in sufficient number to satisfy the loading and unloading system requirements of the compressor.

Different refineries and chemical plants have substantially different separation distances from the storage tanks 20A–20D for barge unloading, and sometimes for rail and/or tank truck unloading. Depending on the separation distance and the chosen pipe size (existing or constructed), the pressure drop of moving the vapor from the vessel from which the liquid is pumped during depressurization to the compressor 16 inlet may be prohibitive. Consequently, the present invention contemplates the use of a second compressor system for overcoming that distance and pressure drop. The minimum requirement for this second compressor system is an inlet separator with heating coil, a compressor, and the required valves, piping and fittings. In more detail, this second compressor system pulls vapor from barge 18 during the depressurization cycle by closing valve 82 and opening valve 84 to route vapor to separator 86. Heated vapor is then pulled into second compressor 88 and out through the discharge check valve 96, prevents back flow of compressed gas into the compressor 16 when the compressor is stopped, and through check valve 60 into vapor line 30. The second compressor 88 is provided with a pressure transmitter 89 and programmable alarm 91 for functioning in the manner described above in connection with compressor 16, but with the reduced requirement of not compressing the tank vapors or vent gas. The temperature of the coil 92 in separator 86 is controlled using the valve 94 in the same manner as described for separator 44. The compressed vapor in line 30 passes through open valves 24 and 26 but valve 28 is closed to direct the compressed vapor to condenser 12. Liquid condensed from the vapor is returned to the storage tanks 20A–20D as described above.

From the foregoing description it can be seen that the present invention provides equipment and methods for balancing the vapor pressure of two vessels during the movement of liquid from one vessel to the other, for depressurizing the vessel from which liquid is pumped, and for assisting with the recovery of vent gas from the vent gas recovery system of the facility. Those skilled in the art who have the benefit of this disclosure will recognize that certain changes can be made to the component parts of the vapor control system of the present invention without changing the manner in which those parts function to achieve their intended result. For instance, as noted above, the separator 86 and compressor 88 are not a necessary part of the system of the present invention in installations in which it is not necessary to overcome a substantial vapor pressure drop. Further, in certain installations such as when there are restrictions in the electrical power available or inadequate cooling water, it may be advantageous to connect the two compressors 16 and 88 in series with the final compressor discharging to the condenser 12 and on to storage tanks 20A–20D. All such changes, and others which will no doubt be made clear to those skilled in the art by this description of the preferred embodiment, are intended to fall within the scope of the following, non-limiting claims.

What is claimed is:

1. In a system for pumping liquid from a first vessel to a second vessel comprising a line connecting the first and second vessels and a pump for pumping liquid from the first vessel to the second vessel through the line, the improvement comprising:

a vapor line connecting the second vessel and the first vessel;

a compressor for pulling vapor off the second vessel and rotating the vapor to the first vessel through said vapor line; and a vaporizer in fluid communication with the line through which liquid is pumped and the vapor line for increasing the volume of vapor routed to the first vessel for pressure balancing the first vessel as liquid is pumped from the first vessel.

2. The apparatus of claim 1 wherein said vapor line is in fluid communication with the head space of the first vessel.

3. The apparatus of claim 2 additionally comprising a line connecting the head space of the second vessel with said vapor line.

4. The apparatus of claim 2 additionally comprising a separator in fluid communication with the second vessel and said vapor line.

5. The apparatus of claim 1 wherein said compressor is provided with a differential pressure transducer for controlling the loading and unloading of said compressor to balance the rate at which liquid is pumped from the first vessel.

6. The apparatus of claim 1 additionally comprising a pressure regulator set to make up vapor pressure from said vaporizer to control vapor pressure to the first vessel.

7. Apparatus for pressure balancing a vessel while pumping liquid from the vessel to a tank and for depressurizing the vessel after the liquid is pumped from the vessel comprising:

a vapor line connecting the head of the tank to the vessel;

a compressor in said vapor line for compressing the vapor from the head space of the tank;

a bypass line connecting the vessel to said vapor line between the tank and said compressor;

a liquid return line having a condenser therein connecting said vapor line and the tank;

a valve in said vapor line between the vessel and said compressor for routing vapor through said bypass line when closed; and a differential pressure transmitter for controlling the output of said compressor output through said vapor line to the vessel to (a) balance the liquid which is pumped from the vessel and (b) depressurize the vessel when said valve is closed, the vapor pulled from the vessel during depressurizing being condensed by said condenser and routed to the tank.

8. The apparatus of claim 7 additionally comprising a separator located in said vapor line between the tank and said compressor.

9. The apparatus of claim 8 wherein said bypass line connects the vessel to said vapor line between the tank and said condenser.

10. The apparatus of claim 8 wherein the hot gas from said compressor is routed through an internal heating coil in said separator for raising the temperature in said separator to vaporize liquid entering said separator.

11. The apparatus of claim 7 additionally comprising a pressure regulator for maintaining the condensing temperature at an optimum temperature.

12. In a system for pumping liquid from a first vessel to a second vessel comprising first and second vessels and a pump for pumping liquid from the first vessel to the second vessel, the improvement comprising:

a vapor line in fluid communication with the head space of the second vessel and the first vessel for returning vapor to the first vessel to replace liquid pumped from the first vessel;

a compressor for pulling vapor off the second vessel;

a condenser in fluid communication with said compressor and the second vessel for changing vapor from said compressor to liquid and routing the liquid to the second vessel;

a line connecting the head space of the second vessel with said vapor line; and a compressor in fluid communication with the head space of the second vessel and the line connecting the head space of the second vessel with said vapor line.

13. The apparatus of claim 12 wherein additionally comprising a vaporizer in fluid communication with the second vessel and said vapor line.

* * * * *